US005198723A

United States Patent [19]

Parker

[11] Patent Number: 5,198,723

[45] Date of Patent: Mar. 30, 1993

[54] LUMINOUS PANEL DISPLAY DEVICE

[76] Inventor: William P. Parker, P.O. Box 909, Waitsfield, Vt. 05673-0909

[21] Appl. No.: 448,693

[22] Filed: Dec. 11, 1989

Related U.S. Application Data

[63] Continuation-in-part of Ser. No. 192,225, May 10, 1988, Pat. No. 4,887,003.

[51] Int. Cl.[5] ..... H01J 61/30; H01J 17/16; G09G 3/22; G09F 13/26

[52] U.S. Cl. ..... 313/634; 313/493; 313/516; 313/519; 340/774; 40/545

[58] Field of Search ..... 313/634, 642, 643, 573, 313/516, 519, 485, 495, 292, 493; 340/716, 717, 774; 40/541, 542, 545, 572

[56] References Cited

U.S. PATENT DOCUMENTS

| | | | |
|---|---|---|---|
| 1,852,229 | 1/1980 | Yoshikawa et al. | 315/169.4 |
| 2,004,577 | 6/1935 | Lebedenko et al. . | |
| 3,127,535 | 3/1964 | Westerheim | 313/109.5 |
| 3,500,390 | 3/1970 | McNaney | 340/378 |
| 3,621,332 | 11/1971 | Janning | 315/313 |
| 3,629,638 | 12/1971 | Veron et al. | 313/109.5 |
| 3,629,654 | 12/1971 | Janning | 315/246 |
| 3,646,384 | 2/1972 | Lay | 313/109.5 |
| 3,764,429 | 10/1973 | Janning | 156/89 |
| 3,903,445 | 9/1975 | Bode et al. | 313/226 |
| 3,987,337 | 10/1976 | Nishida et al. | 315/168 |
| 3,998,510 | 12/1976 | Salisbury | 316/17 |
| 4,019,086 | 4/1977 | Person et al. | 313/518 |
| 4,035,690 | 7/1977 | Roeber | 315/169 |
| 4,038,577 | 7/1977 | Bode et al. | 313/188 |
| 4,106,009 | 8/1978 | Dick | 340/343 |
| 4,157,543 | 6/1979 | Person | 340/758 |
| 4,320,324 | 3/1982 | Ariga et al. | 313/493 |
| 4,327,513 | 5/1982 | de Gunzburg | 40/572 |
| 4,414,490 | 11/1983 | Harvey | 315/169.4 |
| 4,427,479 | 1/1984 | Glaser | 156/286 |
| 4,451,761 | 5/1984 | Kay | 313/586 |
| 4,494,038 | 1/1985 | Wedding et al. | 313/587 |
| 4,529,909 | 7/1985 | Kamegaya et al. | 313/584 |
| 4,549,109 | 10/1985 | Nighan et al. | 313/485 |
| 4,554,482 | 11/1985 | Kamegaya et al. | 313/582 |
| 4,554,537 | 11/1985 | Dick | 340/775 |
| 4,566,006 | 1/1986 | Okamoto et al. | 340/771 |
| 4,584,501 | 4/1986 | Cocks et al. | 313/493 |
| 4,611,203 | 9/1986 | Criscimagna et al. | 340/773 |
| 4,613,794 | 9/1986 | Oida | 315/169.4 |
| 4,742,278 | 5/1988 | Iannini | 315/248 |
| 4,887,003 | 12/1989 | Parker | 313/634 |

FOREIGN PATENT DOCUMENTS

| | | | |
|---|---|---|---|
| 2102151 | 7/1972 | France . | |
| 86061 | 6/1980 | Japan | 313/634 |

*Primary Examiner*—Sandra L. O'Shea
*Attorney, Agent, or Firm*—Lahive & Cockfield

[57] ABSTRACT

A gas discharge display apparatus in the form of an electroluminescent gas filled panel adapted for quickly and inexpensively making a durable and robust luminous sign using image patterns transferred to the panel by painting, silkscreening, stencilling, lithography, or the like. The apparatus generally includes a pair of substantially parallel spaced apart rigid plates, or sheets, enclosing an electroluminescent gas, and having variously located and kinds of conductive elements, such as surface coatings, used as electrodes for energizing the enclosed electroluminescent gas.

5 Claims, 9 Drawing Sheets

LUMINOUS PANEL DISPLAY DEVICE

REFERENCE TO RELATED APPLICATION

This application is a continuation-in-part of my pending U.S. patent application Ser. No. 192,225, U.S. Pat. No. 4,887,003, granted Dec. 12, 1989.

BACKGROUND OF THE DISCLOSURE

The invention is in the field of luminous displays and signs, and more particularly relates to gas plasma display devices.

The production of light by the passage of electricity through gases is a well known phenomenon. Devices utilizing this phenomenon have been widely developed in the form of plasma display devices which display specific numerals, characters, symbols, graphics, and the like. The neon sign is an example of a gas discharge display device, typically including an elongated glass tube filled with neon and a pair of excitation electrodes disposed at opposite ends of the tube. In this example, the rigid tube, or envelope, defines the shape of the illumination pattern. This shape is established at the time of manufacture, and cannot be changed.

Other prior art gas discharge display devices may include a plurality of shaped character electrodes in direct or close contact with an electroluminescent gas within a glass envelope, for example, Nixie tubes. In such devices, selected ones of the shaped electrodes may be energized to obtain a desired character display. Again, the shape of the illumination is predetermined by the shape of the electrode which is established at the time of manufacture of the device.

Still other forms of prior art gas discharge display devices include dielectric-bounded, gas-filled character-shaped channels within an envelope, with a suitable set of energizing electrodes. As in U.S. Pat. No. 3,621,332, a plurality of such channels may be established within a single envelope, with electrodes being arranged for selective activation of one channel at a time. Alternatively, as in U.S. Pat. No. 4,584,501, a single elongated channel may be formed in one plate of a two glass plate sandwich arrangement, with energizing channels in an adjacent plate. All of these arrangements are suitable for displaying indicia, but as with the earlier discussed prior art, the shape of the display, i.e. the channel configuration, is determined at the time of manufacture of the device.

Yet other prior art gas discharge devices include generally similar display configurations, but have an addressable matrix in which selected dot regions may be selectively energized. For example, as shown in U.S. Pat. No. 4,035,690, selected ones of overlapping orthongal sets of electrodes may be energized to generate a desired dot matrix character. In that patent, the electroluminescent gas is confined to the interior of a plurality of dielectric spheres disposed between the sets of electrodes. With the dot addressible matrix, substantial flexibility is provided in that any dot pattern graphics may be displayed, for example using conventional bit-mapped graphics techniques. However, as with the other above mentioned prior art, all possible display patterns, i.e. the electrode overlap regions, are established at the time of manufacture of the device.

Yet another form of prior art gas discharge device is disclosed in U.S. Pat. No. 3,629,654. As shown in that patent, a pair of opposed, spaced apart plates are mutually sealed at their perimeter to establish an electroluminescent gas filled cell. A transparent conductive coating is disposed on one outer surface of the cell. A movable external sheet having predetermined shaped conductive regions is pressed against the other outer surface of the cell and an ionizing signal is applied across the conductive coating and the conductive region of the external sheet to generate a visible discharge in the cell having the shape of the conductive regions of the external sheet. This two-element display thus requires a means for positioning the external sheet relative to the cell in order to establish an image.

It is an object of the present invention to provide an improved plasma display device.

Another object is to provide an improved plasma display device which may be user-programmed for the display of a desired image.

Yet another object is to provide an improved plasma display which may be economically and efficiently configured to display a desired image.

SUMMARY OF THE INVENTION

Briefly, the present invention is an electroluminescent gas filled double walled panel with the provision for electrode surfaces on both sides of the gas space, which will allow for a luminous gas (or plasma) discharge to be generated when suitably energized. The electrode surfaces may be indicia-(or other graphic image-)shaped, thus producing a like shaped pattern of light of sufficient visibility to be useful as a sign, indicator or other expression of visible information.

The pattern of at least one of the electrode surfaces may be provided by a secondary manufacturer, for example, a user, through the means of painting, stencilling, silkscreening, lithography or the like. By so providing the latter electrode surfaces, the inherent difficulties and costs of producing signage (for example, using a heat-bent gas discharge tube of conventional neon tube signs) are overcome, while still producing a luminous gas image. Thus, even a small signage producing enterprise, or home user, may readily utilize the display device of the present invention to display a user desired image.

Additionally, the display panel of the present invention is far more robust, durable and safe than its bent tube neon sign counterpart. In some configurations, the display device has transparent electrodes on both sides of the gas space, making the display device usable as a window or glass door simultaneously with its carrying images or information.

The display panel may also find general usage in the architectural and outdoor illumination field, much as its bent tube neon sign counterpart does currently. Similarly, much as artists and designers use light filled tubes as components of graphic and sculptural statements, the light producing display devices of the invention may be used, with or without patterns to the illuminosity, as an artistic and design medium.

More particularly, in accordance with the invention, a display device includes first and second non-conductive sheet members, each having front and back surfaces, which may be substantially parallel. At least one of the first and second sheet members is transparent.

In a preferred form, the sheet members are rigid and substantially planar, but alternative configurations could be employed, such as similar cylindrical or spherical configurations, or non-rigid configurations. By way of example, the sheet members may be planar sheets of glass. The first sheet member may be substantially transparent and has a coating region on its front surface adapted to receive a first conductive coating (a "pattern electrode") on portions thereof. Typically, this first conductive coating represents the image to be displayed. The first conductive coating may be removable in part to correspond to a modified form of the image. The second sheet member may also be transparent. The first conductive coating may be applied by painting, stencilling, silkscreening, lithography, or the like.

One or more spacer elements mutually position the first and second sheet members so that the back surface of the first sheet member is offset from and opposite the front surface of the second sheet member.

A discharge chamber is established by a gas impervious seal between portions of the back surface of the first sheet member and the front surface of the second sheet member. The discharge chamber defines a closed region in the gap between the back surface of the first sheet member and the front surface of the second sheet member. That closed region underlies at least in part the first conductive coating.

An electroluminescent gas is disposed within the closed region. While other gas mixtures may be used, in the preferred form the electroluminescent gas is a Penning gas mixture comprised substantially of 99% neon, 1% argon, and trace amounts (less than 0.1%) of mercury at a pressure of about 120 torr.

In one form of the invention, a second conductive coating (i.e. a conductive element or "charging electrode") is disposed on a portion of one of the front and back surfaces of the second sheet member underlying at least in part the closed region and a part of the coating region. In other forms, the charging electrode may not underlie the first conductive coating, while still being on one of the front and back surfaces of, or within, or adjacent to the second sheet member. By way of example, the charging electrode may be a wire (e.g. extending at least partially through the closed region, or embedded in the second sheet member), or it may have the form of a conductive portion of the seal which establishes the chamber.

An applied drive voltage may be coupled between the first conductive coating and the charging electrode to energize the device so that a luminous plasma image is established in the portions of the closed region adjacent to the first conductive coating.

In one form of the invention, the spacer includes at least one rigid spacer member disposed within the closed region and extending between the back surface of the first sheet member and the front surface of the second sheet member.

In various embodiments, either or both of the first and second conductive coatings may be substantially translucent, transparent, reflective or opaque. Further, the conductive coating forming the charging electrode may be disposed on the front surface of the second sheet member and at least in part within the closed region. Alternatively, the second conductive coating may be disposed on the back surface of the second sheet member and at least in part overlying the closed region. A third non-conductive sheet member may overlie the second conductive coating opposite the back surface of the second sheet member. A fourth non-conductive sheet member may overlie the first conductive coating. The latter non-conductive sheets may be used to ensure that a user does not contact the electrodes during use. Further, those added sheets provide increased resistance to breakage of the device as a whole. Also, those sheets, when laminated to the first and second sheets, provide increased stiffness of the chamber-defining walls so that relatively thin sheets may be used for the first and second sheet members, using relatively inexpensive (e.g. polycarbonate) material to form the third and/or fourth sheet members.

Various forms of the invention may be adapted to minimize radio frequency interference (RFI) by using shielded configurations, for example where a grounded, conductive element is disposed over the charging electrode. Dual back-to-back displays may be used where an opaque element is disposed between the illuminated regions, so that independent images may be established in those regions for viewing from opposite sides of the display device.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
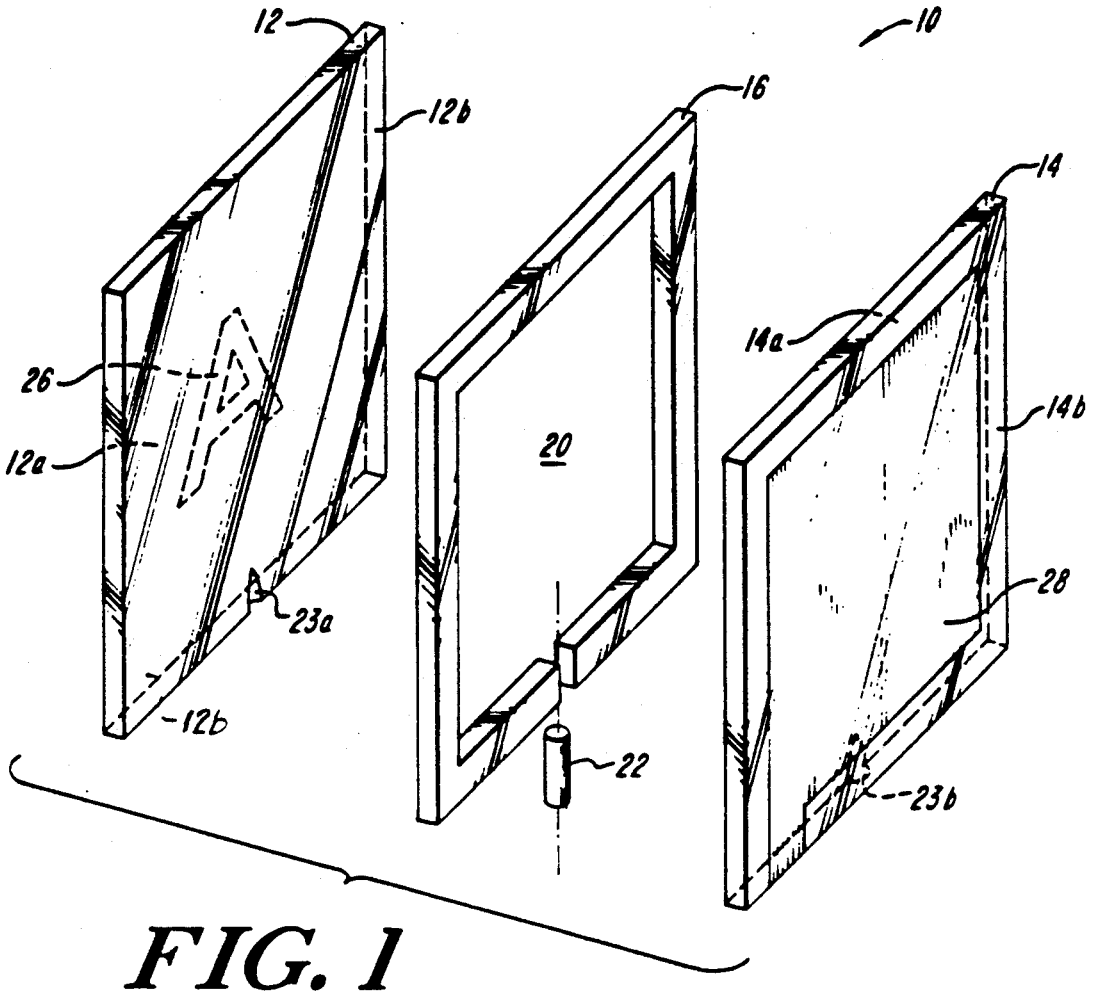
FIG. 1 shows in exploded form, a display device according to the present invention.

An exemplary luminous (plasma) panel display device 10 is shown in FIG. 1 in exploded form. The device 10 includes two flat and parallel non-conducting, transparent glass sheet members 12 and 14 having "front" surfaces **12*a* and 14*a*, respectively, and "rear" surfaces 14*a* and 14*b*, respectively. As shown, sheet members 12 and 14** are substantially planar, but other forms might also be used, such as cylindrical or conical.

An edge seal and spacer element 16 defines an enclosed hermetic volume (or region) 20 having an electroluminescent gas therein. Overlapping conductive coatings 26 and 28 are disposed on the front surface **12*a* of sheet member 12 and on the rear surface of 14*b* of sheet member 14, respectively. In alternative embodiments, a conductive element that generally corresponds to coating 28 may be used, where that element may not overlap any portion of a conductive coating corresponding to coating 26 (for example, as described below in conjunction with FIGS. 2A–2D**), and where that element may not be a coating (for example, as described below in conjunction with FIGS. 2B–2D).

In the embodiment of FIG. 1, a filling stem 22, extending parallel to the principal plane of volume 20, passes between opposing portions of sheet members 12 and 14 and through spacer member 16 to provide access to chamber volume 20. The outer diameter of filling stem 22 is less than or equal to the distance between the front surface 12*a* and the back surface 14*b*. This filling stem 22 permits evacuation and back-filling of the volume 20 following assembly of sheet members 12, 14 and seal/spacer element 16. After back-filling is accomplished, the stem 22 is sealed off. In alternative embodiments, different filling stem configurations may be used. For example, the stem may be placed through a hole drilled through sheet member 12 and fused to the edges of that hole, with the central axis of the stem extending perpendicular to the principal plane of volume 20.

In the preferred embodiment, the sheet members 12 and 14 are non-conductive soda-lime planar glass sheets. The spacer element 16 is also soda-lime glass. The thickness of the sheets is determined to establish (1) a parallel orientation of the two sheets, producing a gas-enclosing space with uniform gap after filling, and (2) total mechanical and thermal stress on the glass sheet members during the assembly and evacuation of the device 10 which does not exceed the properties of the glass, causing breakage. The preferred embodiment has an enclosed volume which is 15 cm by 15 cm, with an inter-sheet gap in the range 0.25–1.0 mm, as established by spacer 16. The soda-lime glass sheet members 12 and 14 are 3.0 mm thick. With larger surface areas, thicker glass sheets may be used, and for smaller areas, thinner glass may be used. For glass with higher resistance to temperature stressing and higher mechanical strength, such as borosilicate glass, the thickness required for any specific surface area may also be reduced im comparison to the soda-lime glass sheets used in the illustrated embodiment. For example, a 15 cm by 15 cm chamber formed by Pyrex brand borosilicate glass sheets with a 1 mm gap, may have 2.5 mm sheet thickness without overstressing.

The embodiment of FIG. 1 is a three element construction (i.e. sheet members 12, 14 and spacer element 16). Other configurations might also be used, for example, two sheet members in a sandwich configuration where one or both of the adjacent surfaces includes an etched chamber-defining region. In the latter configuration, the peripheral spacer is integral with at least one of the sheet members.

In general, spacing and sealing of the chamber 20 of device 10 is provided by a perimeter seal. Various means of hermetically sealing the sheets 12 and 14 and spacer 16 may be used. For example, vacuum epoxy and conventional sealing glasses are suitable. In the illustrated embodiment, the 15 cm by 15 cm panel 10 uses a 1 mm thick, 1.5 cm wide spacer element 16 which is disposed about the periphery of chamber 20. The sealing is performed with unloaded, 100% solids, Type 360T vacuum epoxy formulated and sold by Epoxy Technology of Waltham, Mass. The epoxy seal is obtained with a 10 minute oven bake at 120 degrees C. With this seal, outgassing is less than $5\times10^{-9}$ cc/sec, giving the panel 10 a life on the order of at least 6 months.

As an alternative to vacuum epoxy, Corning Pyroceram brand sealing glass powder, code 7575, may be used to seal soda-lime sheets 10 and 12 to each other using 0.25 to 1.0 mm thick glass spacers. With this method of sealing, the powdered sealing glass is applied as a slurry with a nitrocellulose binder dissolved in a vehicle such as amyl acetate. The binder and vehicle are burned off at 350 degrees C., and the sealing is accomplished at 450 degrees C. during a 60 minute bake. Slow cooling is used to provide a relatively stress free panel with substantially no seal outgassing. Panel life of glass sealed panels is limited by the outgassing of the glass itself and sputtering and gas cleanup, some of which can be greatly reduced by vacuum baking and the inclusion of sputtering reducing vapors such as Hg into the gas fill.

Regardless of which sealing techniques are used, careful cleaning of all surfaces is performed, using conventional techniques prior to assembly and sealing of the sheets 12 and 14. For example, a sequence of water and solvent washes with detergents, distilled and deionized water rinses, vapor degreasing and warm air drying are perfectly performed prior to sealing of the panel 10.

Many gases, gas mixtures and gas pressures may be used in the volume 20 to achieve various colors and intensities of light output using ac drive voltages in the range of 280 to 1800 volts, from 5 kHz to 10 MHz, using sine and square wave signals and complex waveforms. Generally, the electroluminescent gas in chamber 20 is a mixture of noble gases with additions of small quantities of secondary gases to create Penning mixes. In the preferred embodiment, a very effective gas fill with maximum intensity of about 100 lumens at a drive power level of 1.5 watt/cm$^2$ is a Penning mixture made with 99% neon, 1% argon, and trace amounts (less than 0.1%) of mercury, filled to a pressure of about 120 torr. Nitrogen could be substantial for the argon in this exemplary mix. The color of the light output from this panel fill is orange-yellow at maximum brightness (using a photo-optically calibrated sensor) but may be varied slightly by changing the frequency and waveform of the driving ac signal, from yellow-orange to orange-red, with a loss in brightness.

Figure 1A:
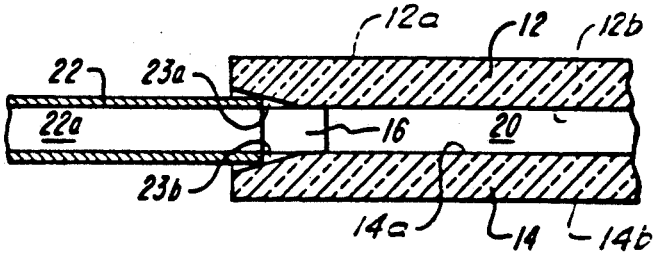
FIG. 1A shows, in section, the portion of the display device of FIG. 1 including the filling stem.

To establish the electroluminescent gas in the enclosed volume 20, the panel 10 is first evacuated through the filling stem 22, as coupled to a vacuum pump through a gas filling system with the suitable filters, pressure and vacuum gauges and compressed gas regulators and valves. In the present embodiment, as the filling stem 22 is established prior to assembly of sheet members 12 and 14 and spacer element 16 by first milling matching conical void regions 23*a* and 23*b* in opposing portions of the periphery of sheet members 12 and 14, and a hole is cut in the corresponding portion of the spacer element 16. As shown in FIG. 1A, the tubular filling stem 22 is then placed into and sealed to the channel established by the conical void regions and spacer hole at the time of assembly and sealing of sheet members 12 and 22 and spacer element 16. The interior 22*a* of stem 22 is contiguous to volume 20. Thus, the stem 22 is sealed to the panel 10 with a through channel to the interior space (i.e. volume 20) formed by the combination of the sheet members 12 and 14 and the spacer element 16. In the preferred embodiment, filling stem 22 is attached to the device 10 with low vapor pressure epoxy or with sealing glass.

In alternate embodiments, the stem 22 may extend through one of sheet members 12 and 14 in a direction perpendicular to the sheet member. To establish such a filling stem, a small hole is diamond drilled through the sheet member and the stem end is flared and ground flat on the sealing surface prior to attachment. The stem is then attached using sealing glass or epoxy.

The use of conductive coatings 26, 28 on the glass sheets 12, 14 allows the panel 10 to illuminate when attached to a source of driving voltage. There are several ways to configure the conductive coatings, depending on the desired visual and operational properties of the final panel 10. The coatings may be overlapping, as shown in FIG. 1, or non-overlapping, as described below in conjunction with FIG. 2A. The panel 10, as shown in FIG. 1 has two conductive coatings 26 and 28, one attached to each of the outer surfaces of the transparent sheets 12, 14 with the electroluminescent gas located between the sheets and not in contact with either coating. Three basic types of conductive coatings identified by their optical properties may be used; namely, transparent, reflective, and opaque.

Transparent conductive coatings pass light, and have little or no color, thus making the coating invisible to the eye. Examples of this kind of coating are vacuum evaporated or sputtered metal films, usually gold or aluminum, and indium doped tin oxide films, either sputtered or chemically deposited on the glass sheet. The coating may be applied in a uniform fashion or may be applied as a pattern.

Suitable coatings have resistivities on the order 0.1 to 100 ohms/square, are thermally stable at sealing temperatures and are generally scratch and chemically resistant. Etching the coating into patterns for use in defining the illumination zone of the panel may be done by the use of silkscreened, painted or stencilled patterns of resist followed by coating removal with chemical (acid or basic) solutions with local or general application, i.e. bath, spray or wipe, or by mechanical means such as abrasion or scraping.

Reflective conductive coatings reflect light, or reflects some percentage of the light falling on it, and are generally partially transparent and partially reflective. Examples are aluminum, chromium, silver or gold coatings with a reflectivity over 10%. The coatings are applied by sputtering, evaporation, chemical deposition or mechanical means, i.e. embossing, and may be applied as patterns or may be uniform and continuous. The resistivity varies from 0.01 to 10 ohms/square for the coatings, and they are generally capable of withstanding sealing temperatures and processing. The coating may be patterned for use as a sign or indicator as described above.

Opaque conductive coatings do not allow the penetration of light to any significant extent. Such coatings allow the view of the gas discharge from one direction only, and give it a higher contrast background. The coating is generally of a paint or ink type consisting of a vehicle, a binder and a conductive component in suspension such as nickel oxide, nickel metal powder, graphite, or mixes of these materials. It may be applied by spraying, rolling, brushing or any of a host of mechanical or chemical means, either as a uniform and continuous coating or as a pattern.

In the embodiment of FIG. 1, front surface 12*a* of sheet member 12 is adapted to receive the first (indicia-shaped) conductive coating 26. The back surface 14*b* of coating 14 supports the second conductive coating 28. Electrical contact to the coatings 26, 28 may be made directly, for example, by wiper arms (not shown) or conductive epoxy (not shown), in a manner permitting an applied drive voltage to be applied across those coatings. The various coatings 26, 28 may each be of the transparent, reflective or opaque type, depending upon the desired luminous image characteristics.

By way of example, in the illustrated configuration, the film coating 28 is a transparent 100 ohms per square deposited indium doped tin oxide film coating 28. As shown in FIG. 1, the front surface 12*a* has received, by silkscreening, a nickel-graphite colloidal suspension coating 26 (e.g. Type 401 conductive paint manufactured by Acheson Colloids, Inc.). With this configuration, a 30 kHz, 900 volt sinusoidal signal applied across coatings 26 and 28 provides a yellow-orange-colored "A"-shaped display. The configuration illustrated in FIG. 1 is particularly well adapted to receive coating 26 by conventional processes such as silkscreening and the like, due to the overall planar structure of device 10, where the filling stem 22 lies substantially in the same principal plane as the device 10.

Figure 1B:
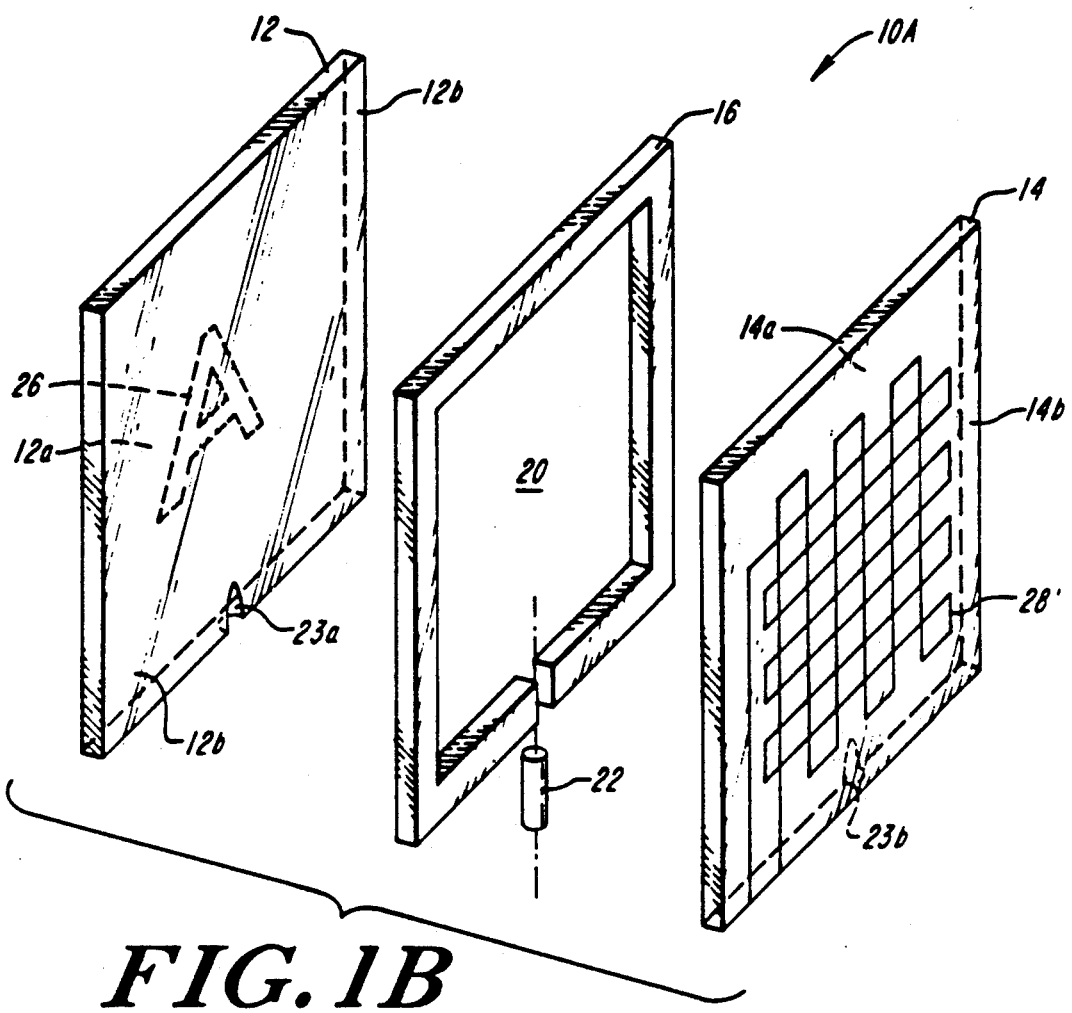
FIG. 1B shows in exploded form, another embodiment of the present invention.

FIG. 1B shows another embodiment 10A in which the sheet member 14 is a wire reinforced safety glass sheet. Wire or a wire grid may either be on the glass sheet surface, or embedded into the glass sheet 14 by means of lamination or suspension. Several versions of wire reinforced safety glazing are commercially available. Customary use of such safety glass is for added strength to the glass sheet, as well as the prevention of excessive fragmentation of the sheet in case of breakage. Some available safety glazing products use continuous individual wires which are laid parallel to each other and spaced at even intervals, while others use a woven wire mesh or wire grid. The use of reinforced safety glass sheets in this embodiment provides a strong surface, which reduces the chance of breakage. The high ratio of open area to wire area provides transparency as well as low resistance electrical contact between the wires in the glass and an external source of current.

The safety glass test panel 10A using a wire electrode was constructed using a normal sheet of glass as the back sheet 12 of the panel, to which was applied a conductive pattern (test pattern) 26 and a sheet of wire reinforced safety glass 14 as the front of the panel. The two glass sheets were sealed at their periphery so that there was a ¼ inch separation between the sheets. The wire grid 28' of the safety glass had been placed interior to the sheet of glass at the time of manufacture by means of suspending it in the glass while it was still molten. The wire grid defined cells approximately 0.5 inch on a side and was made from an iron alloy wire. The grid had been placed approximately one third of the way into a one quarter inch thick plate of window glass. Electrical contact was made to one of the short pieces of wire that normally extend from the cut edge of wire reinforced plate glass (an artifact of the cutting process). The wire-to-wire contact resistance across the grid averaged less than 0.4 ohms per contact in a test of contact resistance made between 20 wires around a one foot square sample. The region 20 between the sheets 12 and 14 was filled with a gas mixture of Neon (99+%) and Xenon (trace), at 160 torr. Other trace gases could be used, such as Nitrogen or Argon, and other pressures may be used, such as 5–250 torr. The equivalent sheet resistance of this embodiment is less than that for an indium doped tin oxide coating on glass. The average per square resistance is comparable to semi-transparent metallic coatings which are approximately 1000 ohms per square. This embodiment provides a low cost, rugged and efficient alternative to continuous conductive coatings.

In operation at low pressures (less than 160 torr), a 4–6 Kvolt peak-to-peak 18–82 kHertz excitation is applied across the pattern electrode and the wire grid. Under these conditions, the safety glass test panel provides an illumination pattern that is similar to a panel with a continuous conductive surface as the charging electrode. At higher pressures, the pattern made by the wires is more discernable in contrast to the test pattern, however, this effect may be reduced by lowering the frequency of the applied voltage.

Figure 2:
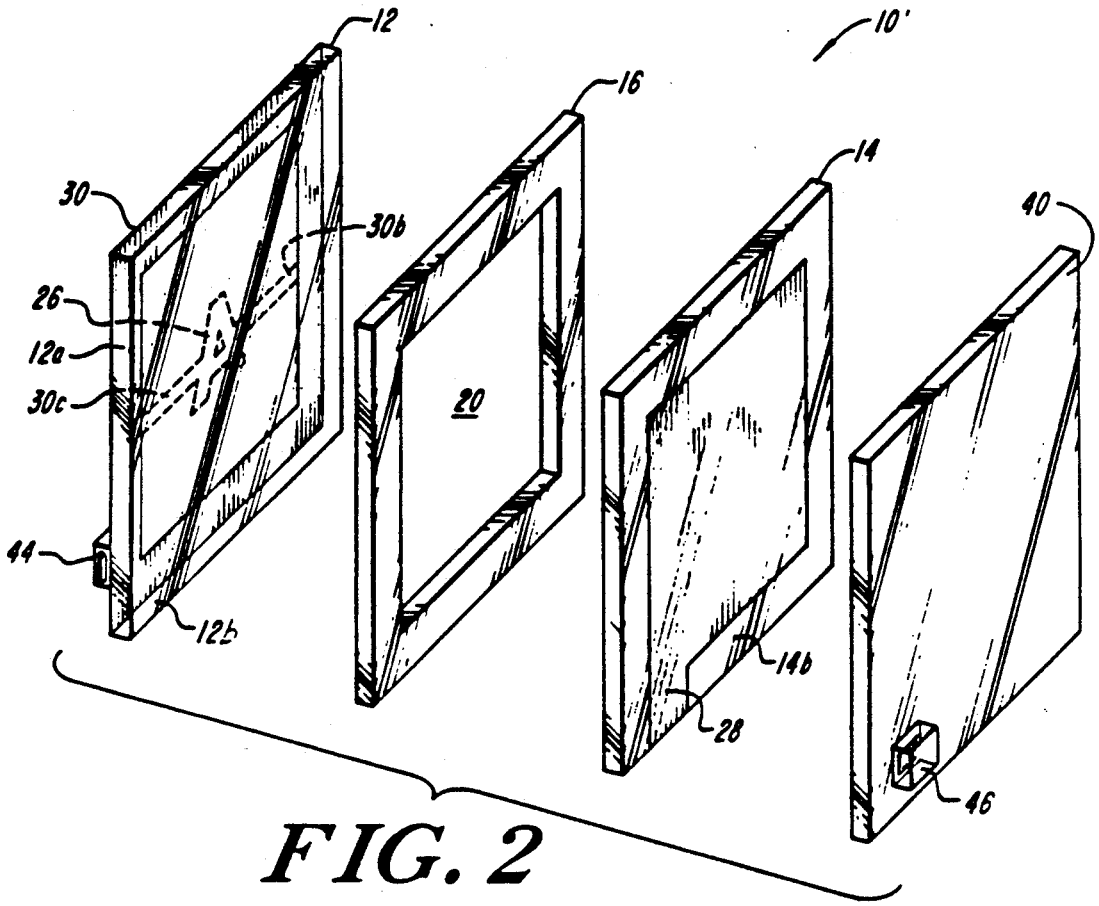
FIG. 2 shows in exploded form, an alternative display device configuration.

FIG. 2 shows a display device 10′ similar to that in FIG. 1 where corresponding elements are identified with the same reference designations as in FIG. 1. In FIG. 2, a conductive border strip 30 is disposed on the peripheral portion of the front surface 12*a* of sheet 12. The border strip 30 is connected to coating 26 by portions 30*a* and 30*b*. With this configuration permits a simple connection (at contact 44) for coupling to an externally applied signal.

The embodiment of FIG. 2 also includes a third non-conductive sheet 40 overlying the back surface 14*b* of sheet 14. Sheet 40 provides an electrical insulation layer for the embodiment of FIG. 2 to protect a user from contacting a drive voltage applied to coating 28, relative to the grounded coating 26. A connector 46 is positioned on sheet 40 and feeds through to coating 28 to provide a convenient means for coupling a drive signal to coating 28. Otherwise, the embodiment of FIG. 2 is similar to and operates in the same manner as the embodiment of FIG. 1.

Another form of the invention uses an electrode configuration with a charging electrode (coating 28) in some location other than in direct opposition to the pattern electrode (coating 26). Gas pressure, electric signal and panel geometry may be controlled to provide an even illumination of the region between sheets 12 and 14 adjacent to the pattern electrode as the charging electrode provides a current path for the discharge current in the panel, even though it is not located directly across from the pattern electrode.

Cathode glow phenomena are the primary source of the illumination energy in these cases, and accordingly, the location of the anode is not critical, but rather the anode must have the ability to transfer current to the external circuit (even though these devices generally utilize a high frequency A.C. drive, so that the distinction between anode and cathode becomes minor). These conditions have been found particularly effective at pressures below 400 torr in neon, or neon with the addition of small percentages of a second rare gas or nitrogen, although the design is effective with other gases and combinations of gases.

In such panels, the location, size and dimensions of the charging electrodes may vary considerably. Preferably, the charging electrode is in proximity to the pattern electrode. In various forms, the charging electrode may have a smaller area than the pattern electrode. The charging electrode may be a wire interior to the panel and making direct contact with the gas. It may alternatively be an appendage containing an electrode which communicates with the gas discharge in the panel through a tube or hole, or a perimeter spacer, or it may be a peripheral seal that is conductive between the edges of sheets 12 and 14. FIGS. 2A–2D show exemplary configurations of these types, wherein elements corresponding to elements in the embodiment of FIG. 1 are shown with the same reference designations. In all of these configurations, contact regions 71 and 73 respectively provide electrical contact to the pattern electrode and the charging electrode.

Figure 2A:
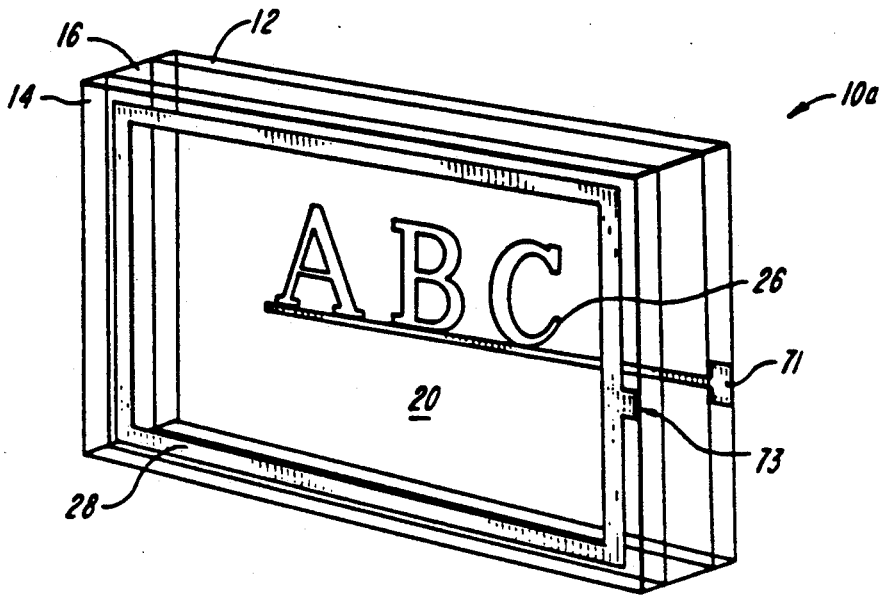
FIGS. 2A–2D show in perspective view variations of the display device shown in FIG. 1.

FIG. 2A shows a display panel 10*a* similar to that in FIG. 1 where the conductive coating (or charging electrode) 28 of sheet 14 is configured and located other than as a uniform conductive sheet opposing any part of the conductive coating 26 of sheet 12. As shown in FIG. 2A, the conductive coating 28 forms a closed geometric pattern near the periphery of the back (or outside) surface 14*b*. Depending on the particular geometry of the pattern electrode ("ABC" in FIGS. 2A–2D), the charging electrode may or may not underlie the pattern electrode.

Figure 2B:
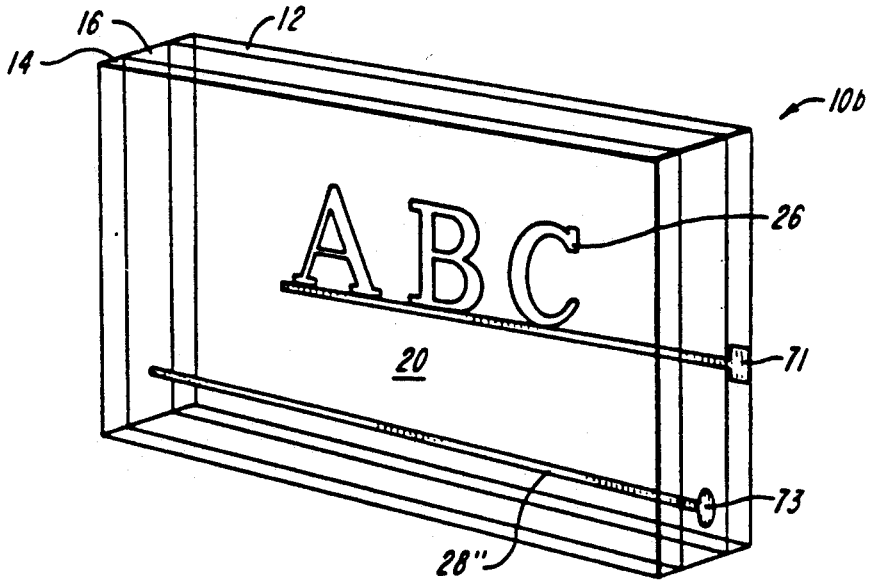

FIG. 2B shows a display panel 10*b* in which the charging electrode is in the form of a wire 28″ extending (in direct contact with the gas in region 20) across the region 20.

Figure 2C:
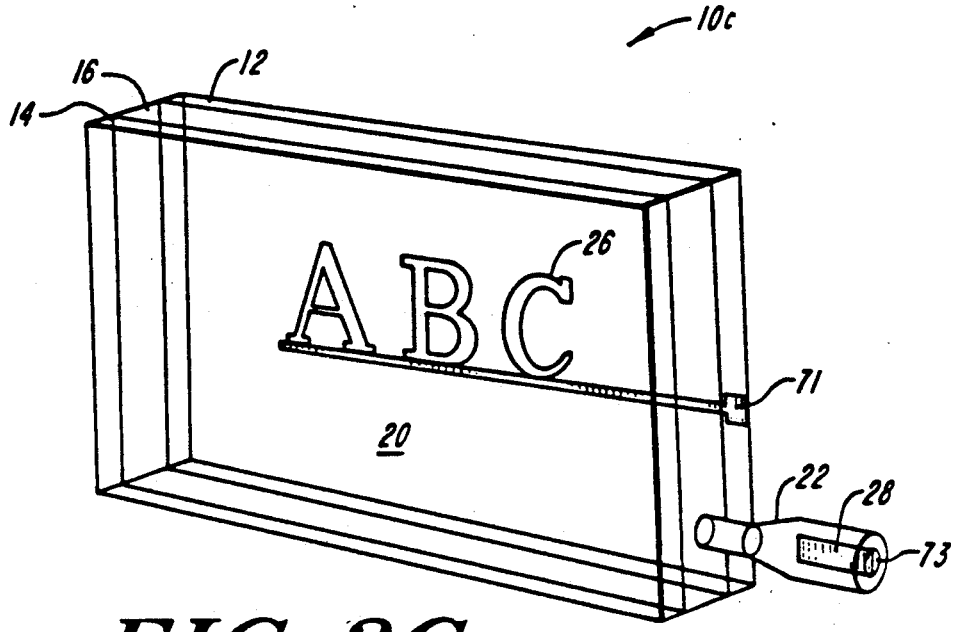

FIG. 2C shows a display panel 10*c* in which the charging electrode is in the form of a conductive element positioned within the filling stem 22, or a separate chamber coupled to the closed region.

Figure 2D:
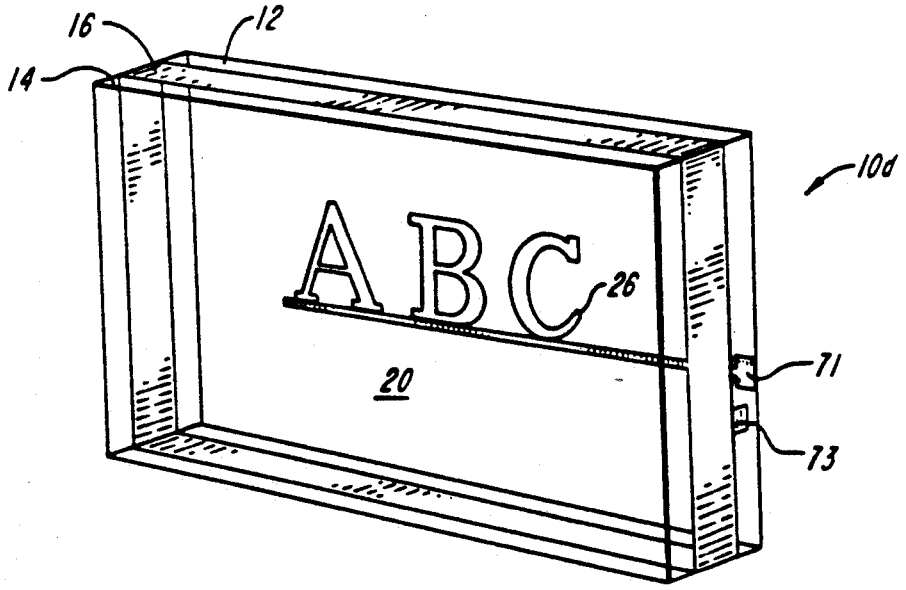

A display panel 10*d* is shown in FIG. 2D, where the spacer element 16 comprises a conductive material. That seal 16 establishes the charging electrode so that the region of chamber 20 adjacent to the pattern electrode 28 is illuminated.

All of these configurations may provide an even illumination of the closed region 20 of the chamber and adjacent to the conductive pattern, for example the "ABC"-shaped pattern in FIGS. 2A–2D.

Figure 3:
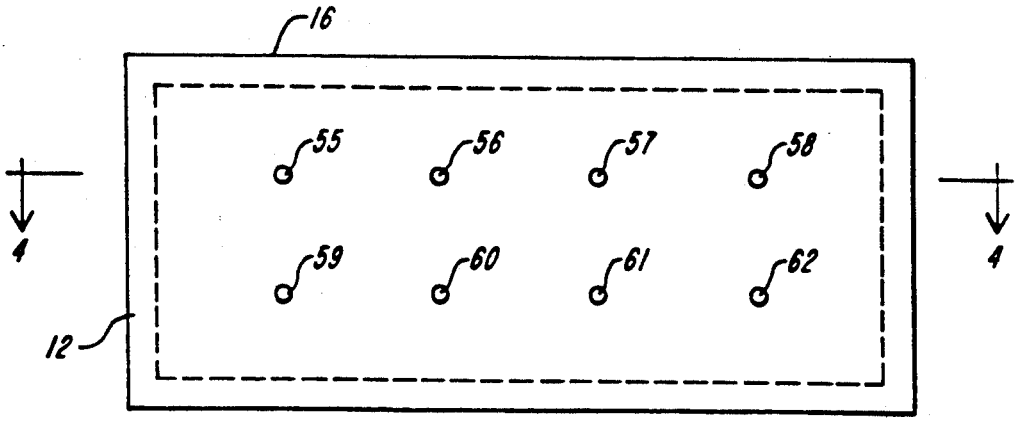
FIG. 3 shows in perspective view, a plasma display device having a plurality of internal spacers.
Figure 4:
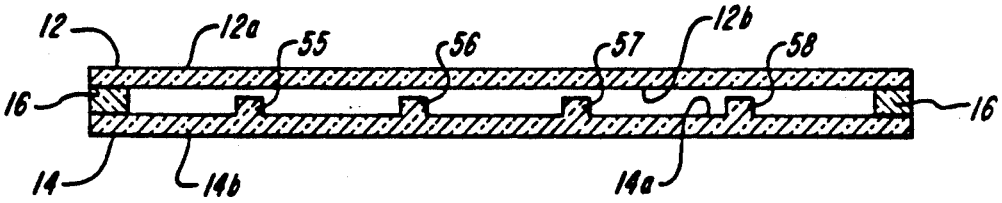
FIG. 4 shows in section along lines 4—4, the plasma display device of FIG. 3.
Figure 5:
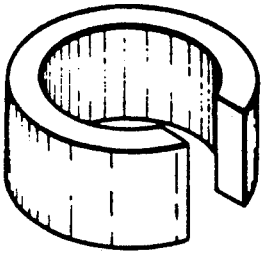
FIG. 5 shows a perspective view of an alternative spacer for use with the device of FIGS. 3 and 4.
Figure 6:
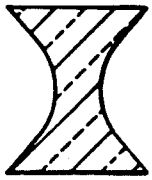
FIGS. 6–9 show sectional views of alternative spacers for use with the device of FIGS. 3 and 4.
Figure 7:
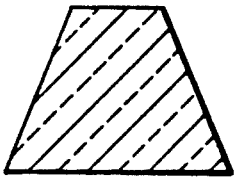
Figure 8:
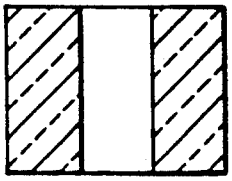
Figure 9:
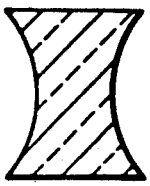

FIGS. 3 and 4 show a similar configuration to the embodiment shown in FIG. 2, but further including eight raised spacers 55–62 projecting from sheet 12 and extending to sheet 14, all within the enclosed volume 20. The spacers permit a relatively large area pair of sheet members to be used while still retaining a relatively high level of structural rigidity. The spacers also permit use of a relatively broad range of gas pressures in chamber 20. The spacers 55–62 as shown are cylindrical in shape. Alternative forms for those spacers are shown in section in FIGS. 5–9. The spacers might be used in any of the above-described embodiments.

In the preferred form of the invention, as shown in FIG. 4, the raised spacers extend only part way between the surfaces 12*b* and 14*a* when enclosed volume 20 is filled with electroluminescent gas. With this configuration, during assembly of near-atmospheric pressure (in enclosed volume 20) embodiments, volume 20 can be evacuated and the raised spacers will play a limit on the resultant displacement of the sheet members 12, 14, thereby permitting use of relatively thin sheet members 12, 14. Then, after backfilling with the electroluminescent gas, the raised spacers again extend only partially between surfaces 12*b* and 14*a*, permitting a substantially uniform luminescent display across the entire enclosed volume 20. The spacers may also be used in embodiments where the sheet members are flexible.

Figure 10:
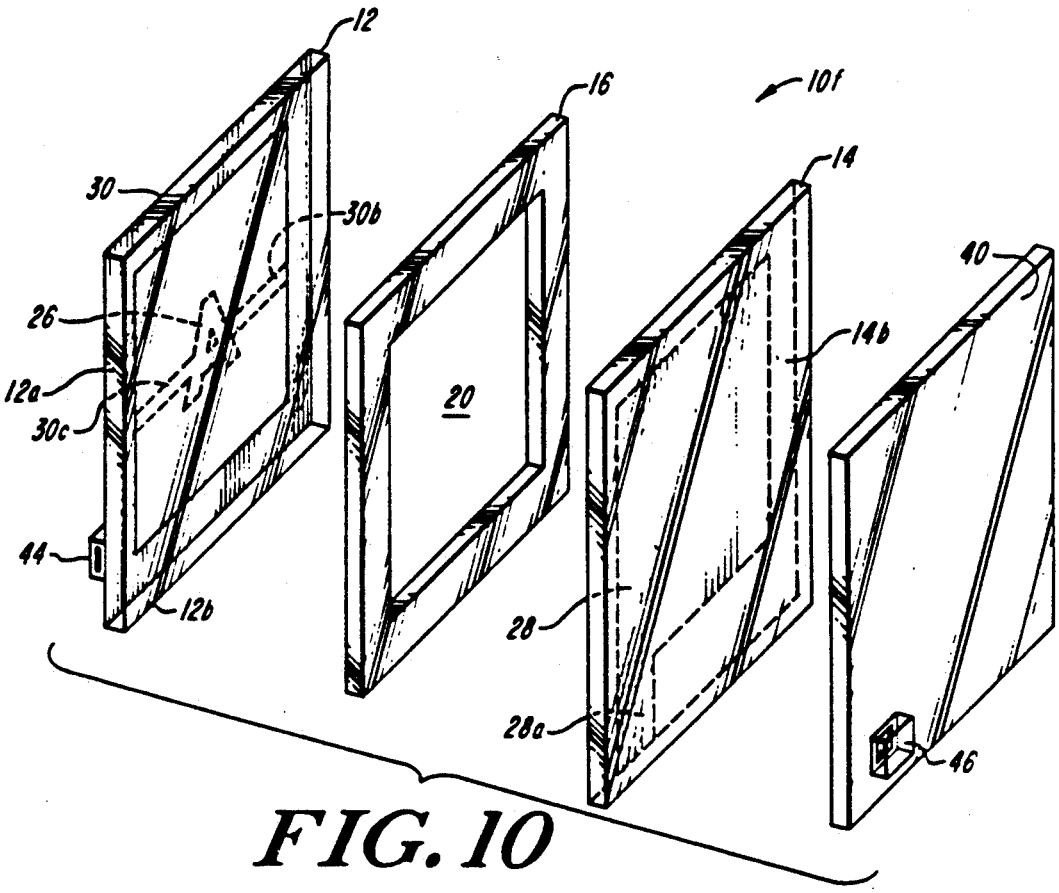
FIG. 10 shows in exploded form, an alternative configuration for a plasma display device of the present invention.

Another embodiment, device 10*f*, is shown in FIG. 10. Device 10*f* is similar to that shown in FIG. 1, except that the coating 28 is disposed on the front surface 14*a* of sheet 14. With this configuration, there is no need for the third sheet 40 since the drive electrode is fully within the enclosed volume 20. Electrical contact is made to coating 28 by a portion 28*a* which extends beyond the seal/spacer element 16.

Here, the coating 28 is in direct contact with the gas in chamber 20. While better electrical coupling is achieved between coating 28 and the gas, a lower drive voltage may be used and increased edge definition for the image is attained, compared with embodiments where coating 28 is on the back surface 14*b*. There is, however, a somewhat reduced lifetime of the device due to sputtering that occurs at the coating 28.

Figure 11:
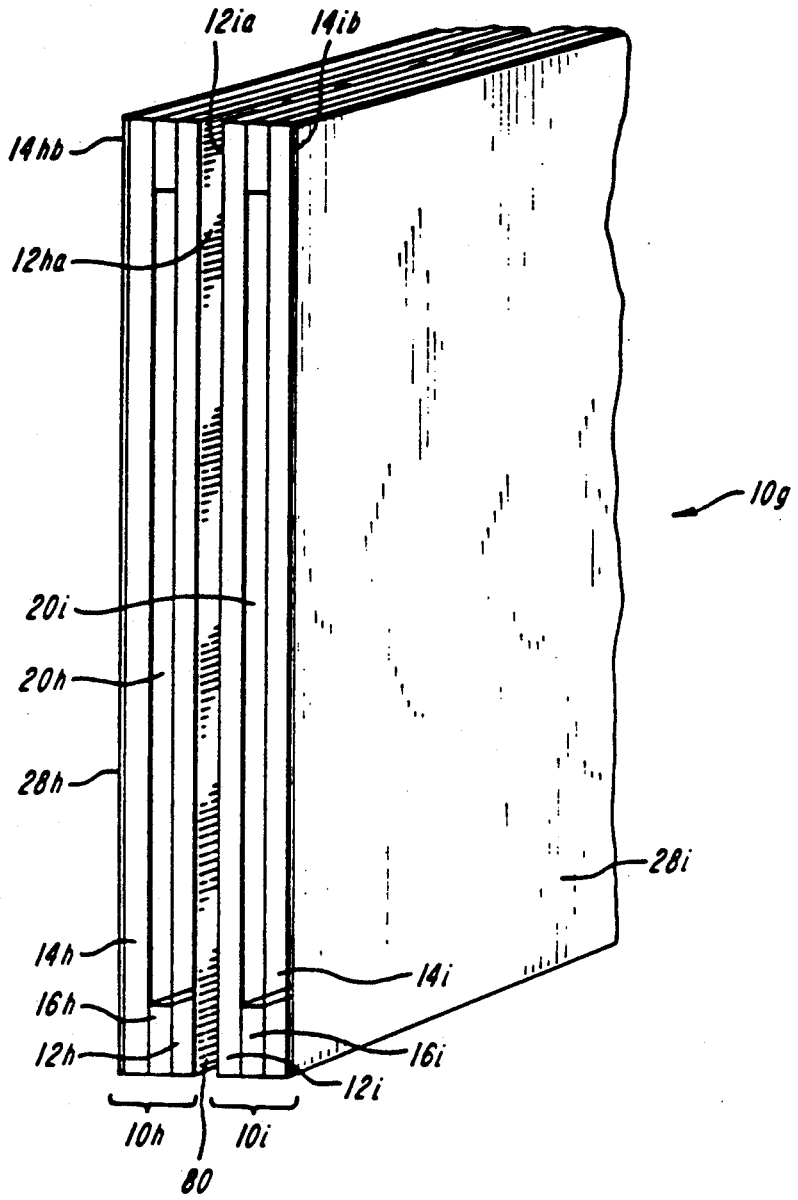
FIGS. 11 and 12 show perspective views of one edge of dual display devices embodying the invention.

FIG. 11 shows a display device 10*g* which allows a display panel (for example, a sign) to be read from both sides without a reversal of the letters from either direction. In this embodiment, there are effectively two devices 10*h*, 10*i* having an adjoining opaque insulating sheet 80. The two devices 10*h*, 10*i* may be mechanically joined within a single frame, or joined with a bonding agent, such as laminating plastic or adhesive. In the case of laminating plastic or adhesive, this may be dyed or otherwise made colored or opaque to increase the viewing contrast of the illuminated pattern.

Each separate device 10*h*, 10*i* comprising device 10*g* may be any of the above embodiments of this invention. For example, the first device 10*h* may comprise a first sheet 14*h* having a transparent conductive coating (charging electrode) 28*h* on the surface 14*hb*, a spacer 16*h*, and a second sheet 12*h* having a conductive coating (pattern electrode) 26 on surface 12*ha*. The second device 10*i* comprises corresponding elements (denoted with designation "*i*") as the device 10*h*. A third component, insulating sheet 80, may be a non-conductive glass sheet, a laminating non-conductive material, or similar opaque material of sufficient thickness and dielectric strength so as to prevent the pattern intended to be read from one direction from illuminating areas in the panel facing the opposite direction. The insulating sheet is attached on one side to the pattern electrode-bearing (inner) surface 12*ha* of device 10*h* and on the other side to pattern electrode-bearing (inner) surface 12*ia* of device 10*i*.

In this embodiment, two separate patterns may be applied to the surfaces 12*ha* and 12*ia* of sheets 12*h* and 12*i*. The presence of opaque insulating sheet 80 would permit the display of two separate patterns, such as letters, to be read from either side.

Since the panels of the invention operate on alternating current at relatively high frequencies, it may be important to provide a means of preventing the escape of an excessive amount of RF radiation. This may be accomplished readily with the configuration of FIG. 11, where the conductive coatings 28*h* and 28*i* cover the entirety of surfaces 14*hb* and 14*ib*. These coatings may be grounded, so that they establish radio frequency interference (RFI) shielding for device 10*g*. Another method of minimizing RFI is to use the dual display device 10*j* shown in FIG. 12. That device is similar to device 10*g*, in that it has two separate display devices 10*k* and 10*l* (each similar to the device of FIG. 1). However, the charging electrodes for these devices 10*k* and 10*l* is a single, perimeter-extending conductive spacer element 90. The pattern electrodes 26*k* and 26*l* are on surfaces 12*ka* and 12*la* respectively and are both grounded to provide RFI shielding. The spacer element 90 is separately shielded, for example by a conductive shield 94 such as a grounded cover frame separated by insulator 96 and extending along the perimeter of the device 10*j*.

An opaque member (similar to element 80 in device 10*g*) may be used in the space between devices 10*k* and 10*l*, to permit two-sided viewing without interference. Alternatively, either or both of sheets 12*h* and 12*i* may be opaque to permit two-sided viewing. The device 10*j* has the advantage over device 10*g* that the pattern electrode may be applied after assembly of the composite dual device.

Figure 12:
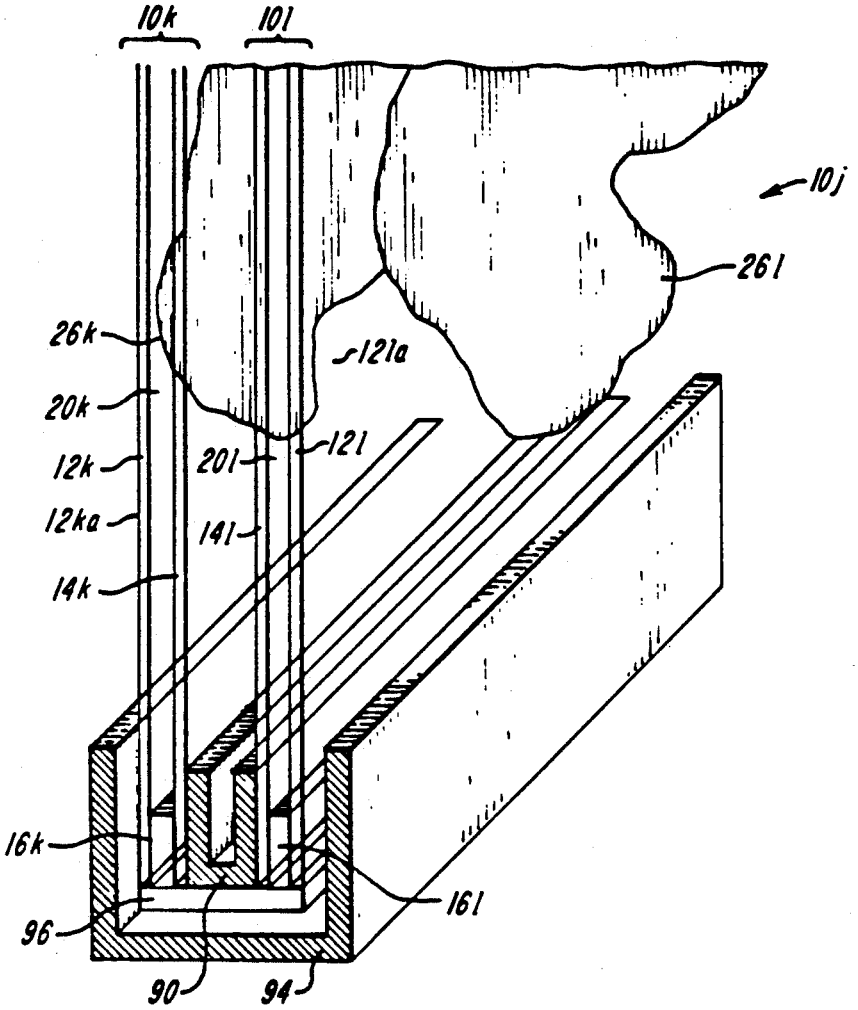

In the dual device configurations, such as shown in FIGS. 11 and 12, at least three of sheet members may all be transparent so that overlapping images (e.g. in regions 20*h* and 20*i* of device 10*g*) may be viewed from at least one side of the device. Depending upon the gas mixtures in the respective regions, different color images may be established in those regions. Moreover, the shapes of the respective regions may be controlled, for example by selecting the shape of spacers in those regions.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A luminous panel display device comprising:

A. a first non-conductive sheet member having front and back surfaces, said first sheet member having a coating region on portions of its front surface, said coating region being adapted to receive a first conductive coating representative of a predetermined image;

B. a second non-conductive sheet member having front and back surfaces, wherein at least one of said first and second sheet members is transparent;

C. spacer means for mutually positioning said first and second sheet members whereby the back surface of said first sheet member is offset by a predetermined separation from and opposite the front surface of said second sheet member;

D. discharge chamber means for establishing a gas impervious seal between portions of the back surface of said first sheet member and the front surface of said second sheet member to define a closed region in the gap between said back surface of said first sheet member and the front surface of said second sheet member and underlying said coating region;

E. electroluminescent gas disposed within said closed region; and

F. a conductive element disposed on a portion of one of the front and back surfaces of, or within, or adjacent to, said second sheet member, wherein said conductive element is a wire positioned on the surface of or within said second sheet member.

2. A display device according to claim 1 wherein said wire establishes a conductive grid.

3. A display device according to claim 2 wherein said grid underlies at least in part said closed region and a portion of said coating region.

4. A luminous panel display device comprising:

A. a first non-conductive sheet member having front and back surfaces, said first sheet member having a coating region on portions of its front surface, said coating region being adapted to receive a first conductive coating representative of a predetermined image;

B. a second non-conductive sheet member having front and back surfaces, wherein at least one of said first and second sheet members is transparent;

C. spacer means for mutually positioning said first and second sheet members whereby the back surface of said first sheet member is offset by a predetermined separation from and opposite the front surface of said second sheet member;

D. discharge chamber means for establishing a gas impervious seal between portions of the back surface of said first sheet member and the front surface of said second sheet member to define a closed region in the gap between said back surface of said first sheet member and the front surface of said second sheet member and underlying said coating region;

E. electroluminescent gas disposed within said closed region; and

F. a conductive element disposed on a portion of one of the front and back surfaces of, or within, or adjacent to, said second sheet member, wherein said conductive element is a wire extending at least partially through said closed region.

5. A luminous panel display device comprising:

A. a first non-conductive sheet member having front and back surfaces, said first sheet member having a coating region on portions of its front surface, said coating region being adapted to receive a first conductive coating representative of a predetermined image;

B. a second non-conductive sheet member having front and back surfaces, wherein at least one of said first and second sheet members is transparent;

C. spacer means for mutually positioning said first and second sheet members whereby the back surface of said first sheet member is offset by a predetermined separation from and opposite the front surface of said second sheet member;

D. discharge chamber means for establishing a gas impervious seal between portions of the back surface of said first sheet member and the front surface of said second sheet member to define a closed region in the gap between said back surface of said first sheet member and the front surface of said second sheet member and underlying said coating region;

E. electroluminescent gas disposed within said closed region; and

F. a conductive element disposed on a portion of one of the front and back surfaces of, or within, or adjacent to, said second sheet member, wherein said conductive element extends at least partially around the periphery of said closed region, and wherein said conductive element is integral with said spacer means.

* * * * *